United States Patent [19]

Gaccetta et al.

[11] Patent Number: 4,805,373

[45] Date of Patent: Feb. 21, 1989

[54] COLLAPSIBLE ELEVATOR FOR PACKAGE ELEVATING WRAPPING MACHINE

[75] Inventors: Joseph M. Gaccetta; Kinred Bowling; Lee E. Trouteaud; Michael A. Whitby, all of Dayton, Ohio

[73] Assignee: Hobart Corporation, Troy, Ohio

[21] Appl. No.: 120,568

[22] Filed: Oct. 1, 1987

[51] Int. Cl.[4] ..... B65B 57/08

[52] U.S. Cl. ..... 53/77; 53/52; 53/556; 493/33

[58] Field of Search ..... 53/77, 52, 69, 67, 556, 53/557, 441, 442, 203; 493/33, 32, 31

[56] References Cited

U.S. PATENT DOCUMENTS

| | | | |
|---|---|---|---|
| 2,470,762 | 5/1949 | Dickenson | 493/33 X |
| 3,398,659 | 8/1968 | Egleston | 493/33 |
| 4,498,893 | 2/1985 | Odom | 493/33 X |
| 4,513,558 | 4/1985 | Treiber | 53/77 |

*Primary Examiner*—James F. Coan

*Attorney, Agent, or Firm*—Biebel, French & Nauman

[57] ABSTRACT

A collapsible elevator for a package elevating wrapping machine comprises a base member, a package supporting member and a pair of spring-biased rods. The rods resiliently engage the package supporting member to maintain it in a package elevating position relative to the base member, yet permit it to be resettably collapsed relative to the base member upon exertion of a defined force on the package supporting member. The package supporting member comprises a top plate and two downwardly extending spaced supports which have notches in their lower ends for receiving the spring-biased rods. The supports define surfaces which taper inwardly toward the top plate to facilitate resetting the elevator. An electrical switch is coupled to the base member and a switch actuating rod is coupled to the package supporting member and adapted to activate the electrical switch upon collapse of the elevator. The package elevating wrapping machine is shutdown upon a signaled elevator collapse to substantially reduce the possibility of damaging the machine by the jam condition which caused the collapse of the elevator.

5 Claims, 4 Drawing Sheets

COLLAPSIBLE ELEVATOR FOR PACKAGE ELEVATING WRAPPING MACHINE

BACKGROUND OF THE INVENTION

The present invention relates generally to package elevating wrapping machines and, more particularly, to a collapsible elevator for use in such machines to reduce the possibilities of jams and damage which can occur as a package is being elevated to be wrapped by the machines.

A large variety of package wrapping machines are known in the prior art. One variety which is presently very popular in the supermarket industry includes a package elevator. In these machines, packages comprising trayed products, such as meat, produce or the like, are placed into the machine at an infeed station, and conveyed from the infeed station to a wrapping station including the elevator which then raises the packages into sheets of wrapping material. The sheets of wrapping material are folded about the packages and secured therebeneath for attactive display of the contents of the packages. An illustrative package elevating wrapping machine is disclosed in U.S. Pat. No. 4,513,558 which issued to Fritz F. Treiber on Apr. 30, 1985, is entitled "Jam Detection and Removal for Wrapping Machine", and is incorporated herein by reference.

Unfortunately, in package elevating wrapping machines, it is possible for packages to become jammed within portions of the machine. In particular, packages may become jammed between the elevator and parts of the film folding apparatus due to misadjustment of the machine or misalignment of the packages on the elevator. Since the wrapping machines are typically large and driven by powerful motors, package jams can damage the machine and also present difficult and time consuming removal problems for the machine operator.

In the prior art, jam conditions are dealt with mechanically by means of torque limiters, lever assemblies, the slippage of drive belts and the like. in the referenced Treiber patent, the wrapping machine is controlled by a computer in accordance with clock counts generated by the main drive shaft of the machine. A jam is detected by counting the number of computer operating cycles which occur during a given clock count. If the number of cycles exceeds a defined number, a jam condition is indicated since such an overflow indicates that the main drive shaft is not moving at normal operating speed and, hence, not changing the clock count.

While the prior art reduces the forces which are brought to bear on packages which are jammed in package elevating wrapping machines, the machines must still be able to exert substantial forces to accomplish wrapping operations on packages weighing up to several pounds. Accordingly, the jams which still occur, even though early detected and of reduced force, can lead to damage of the wrapping machine sufficient to require a service call. This is particularly true in the case of jams involving the elevator which must exert substantial force in synchronism and close cooperation with the relatively more susceptible film underfolding apparatus. Hence, while the severity of a jam can be controlled to some extent by known prior art devices and jams detected to shut down the machine, such jams can still result in substantial damage and time consuming jam removal operations, particularly with relation to the elevator in package elevating machines.

It is thus apparent that the need exists for an improved jam detection and limiting arrangement for the elevator of a package elevating wrapping machine to prevent substantial damage to the machine upon the occurrence of elevator related package jams yet permit the machine to operate at its optimum to produce attractive, tightly wrapped packages.

SUMMARY OF THE INVENTION

In the present invention, the problems of the prior art associated with package jams encountered during package elevation in a package elevating wrapping machine are overcome by means of a collapsible elevator which relieves the forces created during package elevation and stops the wrapping machine to substantially reduce the possibility of damage during such package jams.

In accordance with one aspect of the present invention, a collapsible elevator for a package elevating wrapping machine comprises a base member, a package supporting member and resilient means for coupling the package supporting member to the base member in a package elevating position. The resilient means, while maintaining the package supporting member in the package elevating position, permits it to be resettably collapsed relative to the base member upon exertion of a defined force on the package supporting member. Preferably the collapsible elevator further comprises control means for signaling the collapse of the package supporting member such that the package elevating wrapping machine can be shut down until the problem resulting in the collapse of the elevator is cleared and the elevator is reset to the package elevating position.

The control means may comprise an electrical switch coupled to the base member and a switch actuating rod coupled to the package supporting member and adapted to activate the electrical switch upon collapse of the elevator. Preferably the package supporting member comprises a top plate and two downwardly extending spaced supports connected thereto with the spaced supports having notches in their lower ends. In this embodiment, the resilient means comprises a pair of spring biased rods connected to the base member for engaging the notches to define the package elevating position, yet permitting the package supporting member tp be resettably collapsed by forcing both ends of one rod, both ends of both rods, or the same one end of both rods from the corresponding notches. This arrangement permits universal collapse of the elevator to any side or totally dependent upon the amount of force applied to the elevator and the area of application of the force. To facilitate resetting the elevator, the supports preferably define surfaces which taper inwardly toward the top plate.

It is a primary object of the present invention to provide a collapsible elevator for a package elevating wrapping machine which relieves the otherwise potentially damaging forces created by a package jam associated with the elevator during elevation of a package to be wrapped.

It is another object of the present invention to provide a collapsible elevator for a package elevating wrapping machine which not only relieves the potentially damaging forces created by a package jam associated with the package elevator during elevation of a package to be wrapped, but also prevents any further substantial buildup of forces by signaling the collapse of the elevator to a control system for the wrapping machine such that the machine can be stopped.

Other objects and advantages of the present invention will be apparent from the following description, the accompanying drawings, and the appended claims.

DETAILED DESCRIPTION OF THE INVENTION

Figure 1:
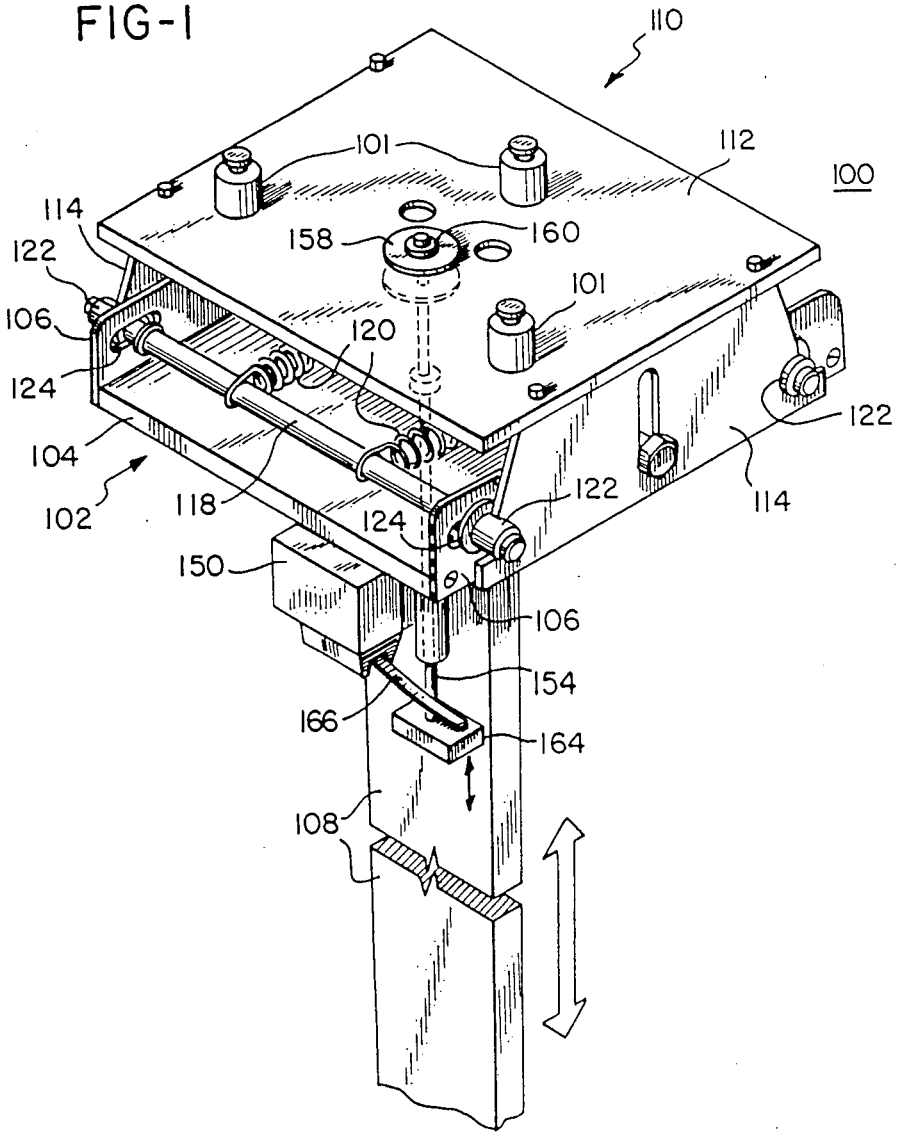
FIG. 1 is a perspective view of a collapsible elevator in accordance with the present invention.
Figure 2:
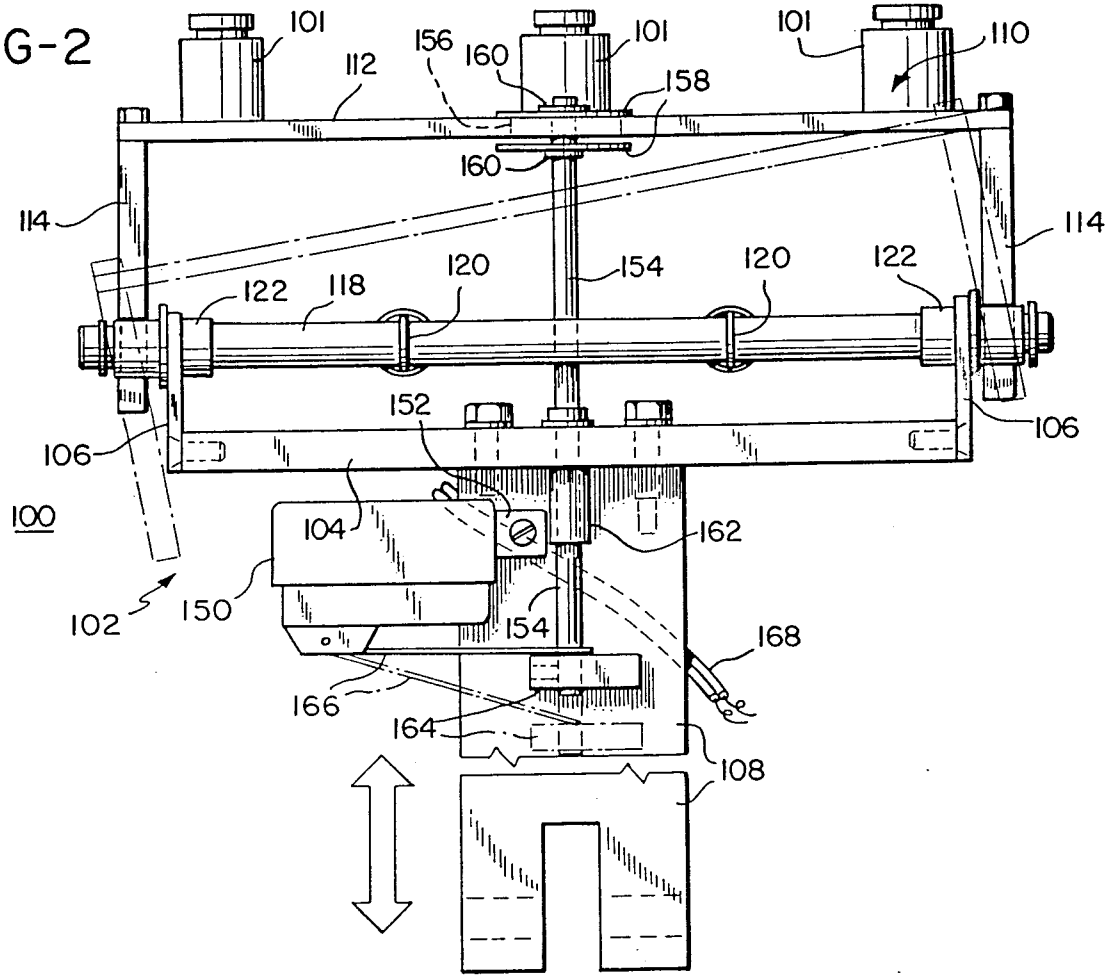
FIGS. 2–4 are a front, top and side view of the elevator of FIG. 1.
Figure 3:
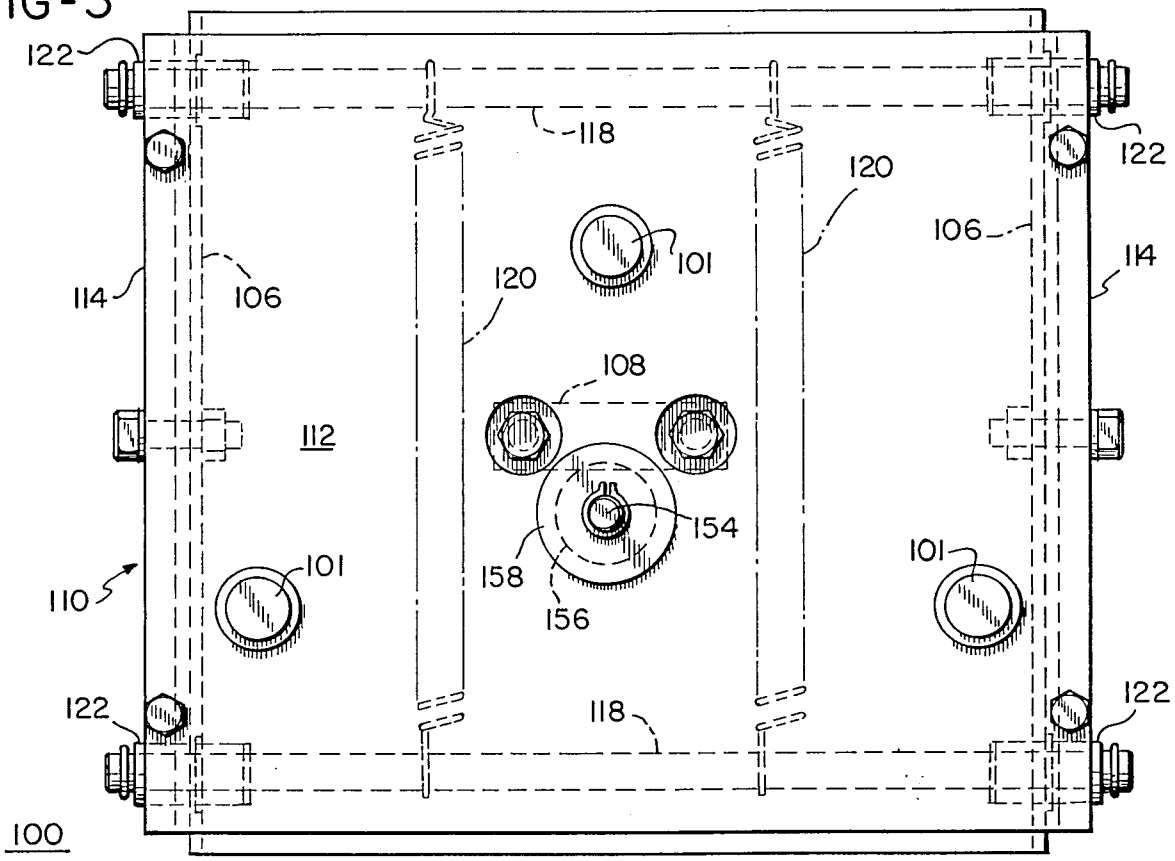
Figure 4:
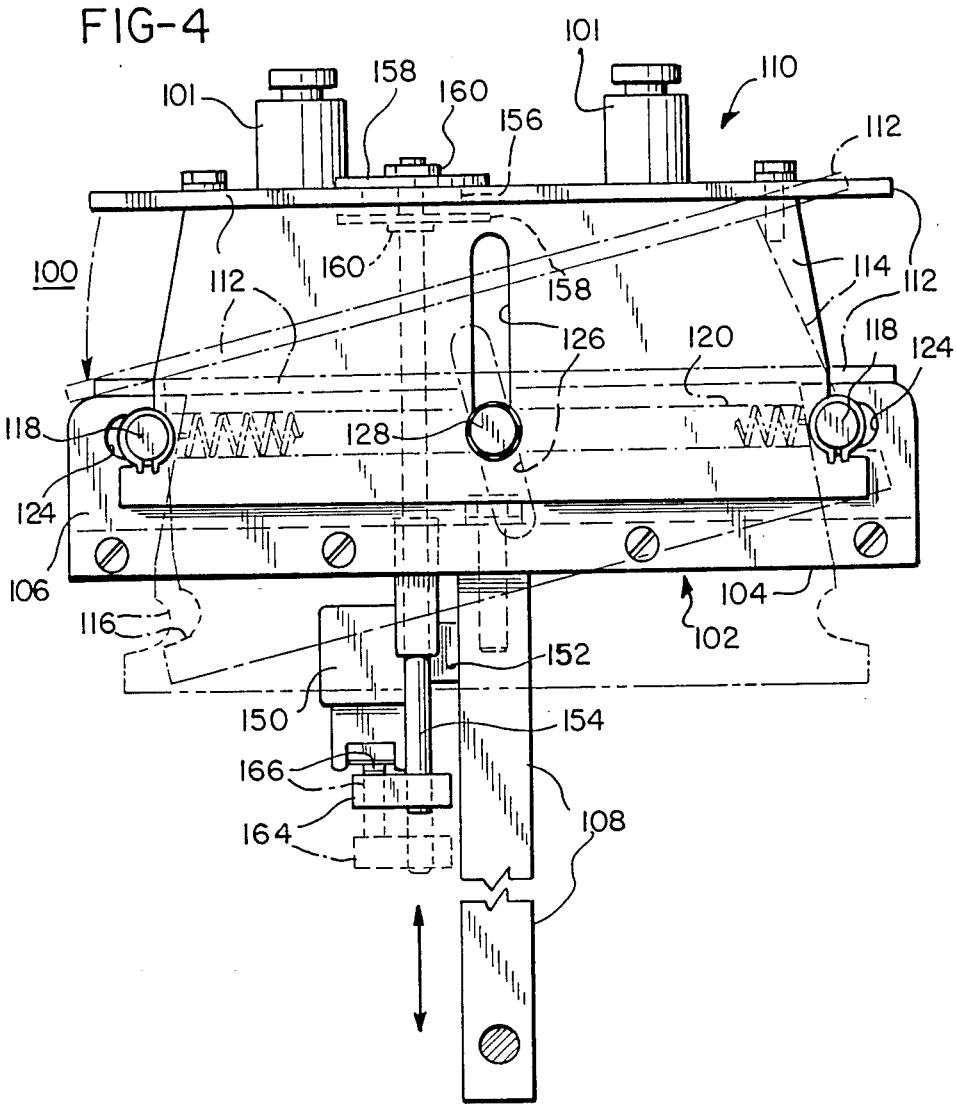

A collapsible elevator 100 in accordance with the present invention for a package elevating wrapping machine is shown in FIGS. 1–4. While the collapsible elevator 100 may be used directly for some elevating wrapping machines, when used on a commercially popular variety of such machines represented by the machine illustrated in U.S. Pat. No. 4,513,558, it serves as a base platform for a package supporting portion of the elevator. In these machines, the package supporting portion of the elevator is coupled to the collapsible elevator 100 via bosses 101 and includes a plurality of hingedly mounted slats biased toward the upright position for receiving and supporting packages placed thereon. The structure of such a package supporting portion of the elevator and its coupling to a base platform are well known in the art, and hence, will not be described further herein.

The collapsible elevator 100 comprises a base member 102 made up of a base plate 104 and end plates 106. The base member 102 is secured to a shaft 108 which is reciprocated in the vertical direction by means of an elevator cam (not shown) or otherwise. A package supporting member 110 comprises a top plate 112 which is generally horizontal, as shown in solid line drawings in FIGS. 1–4, when the elevator 100 is in a package elevating position and two downwardly extending spaced supports 114 connected thereto.

The spaced supports 114 have outwardly facing notches 116 (see FIG. 4) in their lower ends which engage resilient means for coupling the package supporting member 110 to the base member 102 to maintain the package supporting member 110 in the package elevating position shown in solid line drawings in FIGS. 1–4. In the illustrated embodiment, the resilient means comprises a pair of rods 118 which are spring-biased toward one another by means of a pair of extension springs 120. While the springs 120 are illustrated as extending the entire length between the rods 118, it may be preferred to terminate one end of each spring in a bolt which extends through the rod 118 and permits adjustment of spring tension.

The rods 118 have bushings 122 mounted at their distal ends and extending within slots 124 through the end plates 106 of the base member 102 to engage the notches 116. The sides of the spaced supports 114 taper inwardly from the notches 116 toward the top plate 112 of the package supporting member 110 to facilitate resetting the elevator after it has been collapsed. Preferably, the tapering sides of the spaced supports 114 are formed to have a neutral effect upon the collapse of the elevator or to slightly favor collapse once it has started. This ensures sufficient collapse of the elevator to activate a machine interrupting control switch as will be described hereinafter.

It should be apparent upon reviewing the drawing figures that the package supporting member 110 can be collapsed relative to the base member 102 by means of a sufficient force applied to any portion of the top plate 112, such as by a package supported directly or indirectly thereon jamming or engaging a portion of an associated elevating wrapping machine. The collapse dislodges both ends of one of the spring-biased rods 118 from the associated notches 116 as shown in phantom in FIG. 4; the same one end of both of the rods 118 from the associated notches 116 as shown in phantom in FIG. 2; or both ends of both of the rods 118 from all of the notches 116 as shown in phantom in FIG. 4. Hence, the elevator is universally collapsible in that it can collapse to any side or totally collapse. The particular collapsed state of the elevator depends upon the forces causing the collapse and a collapse can go from a one-sided partial collapse to a total collapse under a large variety of dynamic conditions and continuing forces.

The package supporting member 110 is resettably collapsed relative to the base member 102, since if the package supporting member 110 is lifted relative to the base member 102, any dislocated notches 116 are once again engaged with the associated spring-biased rods 118 or, more correctly the bushings 122. The collapse of the package supporting member 110 relative to the base member 102 is stabilized by means of slots 126 through the supports 114. The slots 126 receive sleeved bolts 128 which are in turn secured to the end plates 106 of the base member 102.

Preferably, the collapsible elevator 100 in accordance with the present invention further comprises control means for signaling elevator collapse, i.e., the collapse of the package supporting member 110 relative to the base member 102. The package elevating wrapping machine utilizing the collapsible elevator 100 can then be shut down upon collapse of the elevator 100 until the problem causing the collapse is cleared and the elevator is reset to the package elevating position. In the illustrated embodiment, the control means comprises an electrical switch 150 which is coupled to or fixed relative to the base member 102 by means of a connecting strap 152 which is secured to the elevator shaft 108.

A switch actuating rod 154 is coupled to the package supporting member 110 and adapted to activate the electrical switch 150 upon collapse of the elevator 100. The switch actuating rod 154 passes through an enlarged opening 156 in the top plate 112 of the package supporting member 110. Washers 158 are fitted on the rod 154 on either side of the top plate 112 and retained by a pair of snap rings 160. This coupling arrangement permits the switch actuating rod 154 to be maintained in a vertical orientation by means of an elongated bushing 162 which is secured through the base plate 104 of the base member 102 for any collapsed state of the elevator 100. A switch actuating member 164 is secured to the lower end of the switch actuating rod 154 beneath the elongated bushing 162 and engages an operating lever 166 of the electrical switch 150.

When the elevator 100 is resiliently set to the package elevating position, the switch 150 signals that positioning through a pair of conductors 168 to a control system for the package elevating wrapping machine utilizing the elevator 100. If the elevator is collapsed, the switch 150 is activated to signal the control system of the package elevating wrapping machine such that the machine is shutdown to prevent or reduce any damage which might otherwise be caused by the jam which caused the elevator 100 to collapse. Once the elevator has been collapsed and the switch 150 activated, resetting the elevator will return to switch 150 to its machine operating position; however, the switch 150 is connected into the machine control system such that the machine will not be restarted. Package wrapping can be resumed only by operator activation of the wrapping machine from the main control panel in the same manner as required to initially start the machine.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A collapsible elevator for a package elevating wrapping machine comprising:

a base member;

a package supporting member; and resilient means for coupling said package supporting member to said base member in a package elevating position, said resilient means permitting said package supporting member to be resettably collapsed relative to said base member upon exertion of a defined force on said package supporting member.

2. A collapsible elevator for a package elevating wrapping machine as claimed in claim 1 further comprising control means for signaling the collapse of said package supporting member whereby said package elevating wrapping machine can be shut down until the problem resulting in the collapse is cleared and the package supporting member is reset to said package elevating position.

3. A collapsible elevator for a package elevating wrapping machine as claimed in claim 2 wherein said control means comprises an electrical switch coupled to said base member and a switch actuating rod coupled to said package supporting member and adapted to activate said electrical switch upon the collapse of said package supporting member.

4. A collapsible elevator for a package elevating wrapping machine as claimed in claim 2 wherein said package supporting member comprises a top plate and two downwardly extending spaced supports connected thereto, said spaced supports having notches in their lower ends, and said resilient means comprises a pair of spring biased rods connected to said base member for engaging said notches to define said package elevating position yet permit said package supporting member to be resettably collapsed by forcing said notches from one or both of said rods.

5. A collapsible elevator for a package elevating wrapping machine as claimed in claim 4 wherein said supports define surfaces which taper inwardly toward said top plate to thereby facilitate resetting said elevator.

* * * * *